US008391518B2

(12) United States Patent
Akino

(10) Patent No.: US 8,391,518 B2
(45) Date of Patent: Mar. 5, 2013

(54) CONDENSER MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 176 days.

(21) Appl. No.: 12/926,303

(22) Filed: Nov. 9, 2010

(65) Prior Publication Data

US 2011/0116660 A1 May 19, 2011

(30) Foreign Application Priority Data

Nov. 17, 2009 (JP) ..... 2009-261617

(51) Int. Cl.
*H04R 25/00* (2006.01)

(52) U.S. Cl. ..... 381/174; 381/189; 381/111; 381/113

(58) Field of Classification Search ..... 381/174, 381/189, 111, 113
See application file for complete search history.

(56) References Cited

U.S. PATENT DOCUMENTS 7,382,889 B2 * 6/2008 Akino ..... 381/113
2006/0132257 A1 * 6/2006 Wang et al. ..... 333/12

FOREIGN PATENT DOCUMENTS

JP 2007-324804 A * 12/2007

* cited by examiner

*Primary Examiner* — Fan Tsang
*Assistant Examiner* — Shawn Gotch
(74) *Attorney, Agent, or Firm* — Manabu Kanesaka

(57) ABSTRACT

There is provided a condenser microphone in which even if strong electromagnetic waves are applied from a cellular phone or the like, the balance between a filter circuit for a No. 2 pin on the hot side and a filter circuit for a No. 3 pin on the cold side is maintained. The condenser microphone includes a printed wiring board 200 housed in a microphone casing and a three-pin type output connector, and is configured so that a No. 1 pin of the output connector is connected directly to the microphone casing and is connected to a ground electrode of the printed wiring board 200 via a high-frequency choke coil IL; on the printed wiring board, a first filter circuit 401 connected to the No. 2 pin on the hot side and a second filter circuit 501 connected to the No. 3 pin on the cold side, both filter circuits each including capacitor devices C and inductor devices L, are mounted; and the first and second filter circuits 401 and 501 are disposed so as to be substantially symmetrical with each other with respect to an imaginary centerline X1-X1. In the condenser microphone, the high-frequency choke coil IL is provided in the number of two, and these choke coils IL1 and IL2, together with the first and second filter circuits 401 and 501, are disposed so as to be substantially symmetrical with each other with respect to the imaginary centerline X1-X1.

7 Claims, 4 Drawing Sheets

CONDENSER MICROPHONE

CROSS-REFERENCE TO RELATED APPLICATION

The present application is based on, and claims priority from, Japanese Application Ser. No. JP2009-261617, filed Nov. 17, 2009, the disclosure of which is hereby incorporated by reference herein in its entirety.

TECHNICAL FIELD

The present invention relates to a condenser microphone and, more particularly, to a technique for preventing high-frequency electromagnetic waves which are generated from a cellular phone or the like from intruding into a microphone casing.

BACKGROUND ART

A condenser microphone incorporates an impedance converter such as a field effect transistor (FET) or the like because the microphone unit thereof has a very high impedance. In the condenser microphone, a phantom power source is used, and microphone sound signals are sent via a balanced shielded cable of the phantom power source.

To connect the balanced shielded cable, a three-pin type output connector is provided on the microphone casing (microphone grip in a handheld microphone) side (for example, refer to Japanese Patent Application Publication No. H11-341583). The output connector is a connector specified in EIAJ RC-5236 "Latch Lock Type Round Connector for Audio Equipment", and the configuration thereof is described below with reference to FIGS. 3 to 6.

FIG. 3 is a sectional view showing a state in which the output connector is mounted in the microphone casing, and FIG. 4 is a front view of the output connector removed from the microphone casing. In FIG. 3, the output connector is shown in a cross section taken along the line A-A of FIG. 4. FIG. 5 is a plan view of the output connector.

According to these figures, the output connector 10 includes a disc-shaped connector base 11 formed of an electrical insulating material such as PBT (polybutadiene terephthalate) resin. In the connector base 11, three pins, that is, a No. 1 pin E for grounding, a No. 2 pin SH on the hot side for signal, and a No. 3 pin SC on the cold side for signal are penetratingly provided by force fit, for example.

Concerning the handheld microphone, as shown in FIG. 3, the output connector 10 is mounted in a connector housing cylinder 20 screwed to an end portion of the microphone grip, not shown, formed in a cylindrical shape. Usually, the microphone grip including the connector housing cylinder 20 is formed of a metallic material such as brass, and also functions as a casing for shielding the incorporated electrical parts.

In the connector base 11, a male screw 12 is provided to electrically connect the No. 1 pin E for grounding to the connector housing cylinder 20. The male screw 12 is housed in a screw housing hole 13 pierced in the radial direction in the connector base 11. Also, the connector base 11 is provided with an earth terminal plate 14 having internal threads 14*a* threadedly engaging with the male screw 12 in the screw housing hole 13.

As shown in the plan view of FIG. 5, the earth terminal plate 14 and the No. 1 pin E for grounding are electrically connected to each other via a connecting member 15. As shown in FIG. 3, the male screw 12 is brought into contact with the peripheral edge of a round hole 21, which is pierced in the connector housing cylinder 20, by turning the male screw 12 using a screwdriver, not shown, from the round hole 21.

Thereby, the No. 1 pin E for grounding and the connector housing cylinder 20 are electrically connected to each other via the male screw 12, the earth terminal plate 14, and the connecting member 15. In addition to this configuration, as shown in FIGS. 4 and 5, in some cases, a plate spring 16 contacting with the inner surface of the connector housing cylinder 20 is connected to the No. 1 pin E for grounding so that the No. 1 pin E for grounding and the connector housing cylinder 20 are electrically connected to each other by this plate spring 16.

Even if the No. 1 pin E for grounding is electrically connected to the connector housing cylinder 20 in this manner, when strong electromagnetic waves emitted from a cellular phone or the like are applied to the microphone or a microphone cable (balanced shielded cable) in the state in which the microphone cable pulled out of the phantom power source (not shown) side is connected to the output connector 10, in some cases, the electromagnetic waves intrude into the microphone through the output connector 10, being demodulated by the impedance converter, and are delivered from the microphone as noise having an audio frequency.

To solve this problem, the invention described in Japanese Patent No. 4273019 has disclosed a condenser microphone in which an electronic circuit for microphone unit is incorporated in the microphone casing, and the output connector is mounted to an end portion of the microphone casing. In this condenser microphone, the No. 1 pin for grounding is connected directly to the microphone casing and is connected to the ground of the electronic circuit via a high-frequency choke coil, and the ground is connected to the microphone casing via a lead wire, whereby high-frequency electromagnetic waves, which may cause the generation of noise, are prevented from intruding into the microphone casing through the output connector.

As another method for preventing electromagnetic waves from intruding into the microphone through the output connector 10, there is available a method in which, as shown in FIG. 5, capacitor devices C are connectingly provided between the No. 1 pin E for grounding and the No. 2 pin SH on the hot side and between the No. 1 pin E for grounding and the No. 3 pin SC on the cold side, and the No. 2 pin SH on the hot side and the No. 3 pin SC on the cold side are connected to the microphone casing including the connector housing cylinder 20 via an inductor device L for inhibiting high frequencies from intruding.

By a filter circuit consisting of the capacitor devices C and the inductor devices L, ordinary broadcast waves and electromagnetic waves such as HF, VHF, and UHF waves can be prevented from intruding almost without problems. However, a problem occurring when the condenser microphone is exposed to considerably strong electromagnetic waves emitted from a cellular phone is described below with reference to a schematic view of FIG. 6.

In FIG. 6, Z1 denotes an impedance of the filter circuit including the capacitor devices C and the inductor devices L, which are connected to the No. 2 pin SH on the hot side on the primary side of an output transformer T of the microphone, Z2 denotes an impedance of the filter circuit including the capacitor devices C and the inductor devices L, which are connected to the No. 3 pin SC on the cold side similarly on the primary side of an output transformer T of the microphone, Z3 and Z4 are impedances existing on the hot side and the cold side, respectively, of the balanced shielded cable for phantom power source. In order for noise to be canceled, design is made so that the impedances Z1 and Z2 are in balance, and the impedances Z3 and Z4 are in balance.

However, if the impedances Z1 and Z2 of each filter circuit are not in balance (imbalanced) in a high frequency region, when a high-frequency signal Ua is fed from a cellular phone or the like, an imbalanced signal Ub that is not canceled is generated between the hot side and the cold side, whereby a high-frequency current is caused to flow in the microphone casing including the connector housing cylinder 20, so that noise louder than ordinary is generated.

In the case where the output transformer T of the microphone is wired by using a relatively long lead wire, depending on the length and layout of the lead wire, the impedances Z1 and Z2 of each filter circuit become imbalanced even at frequencies of VHF band, so that noise may be generated.

Considering this issue, in the invention described in Japanese Patent Application Publication No. 2007-324804, as shown in FIG. 7, in forming a first filter circuit 102 for the No. 2 pin on the hot side and a second filter circuit 103 for the No. 3 pin on the cold side on a printed wiring board 100, both of the filter circuits 102 and 103 are substantially symmetrical (in FIG. 7, symmetrical in the up-and-down direction) with each other with respect to the X-X line passing through a middle-point line pattern 143, for example, connected to a middle-point tap of the output transformer.

That is, the first filter circuit 102 includes three land parts 121, 122 and 123, a common mode choke coil CL, two capacitor devices C1 and C2, and one inductor device L1. Similarly, the second filter circuit 103 includes three land parts 131, 132 and 133, a common mode choke coil CL, two capacitor devices C1 and C2, and one inductor device L1. These land parts and devices are arranged so as to be substantially symmetrical with each other, respectively, with respect to the X-X line.

Also, a No. 1 pin connection land 110 to which the No. 1 pin for grounding is connected and a No. 2 pin connection land 120 to which the No. 2 pin on the hot side is connected are arranged so as to be substantially symmetrical with each other with respect to the X-X line. Because of the space condition, the No. 3 pin on the cold side is connected to a No. 3 pin connection land on the back surface side of the printed wiring board 100, and the No. 3 pin connection land is pulled out to the top surface side of the printed wiring board 100 via a through hole wiring 130.

Also, according to the invention described in Japanese Patent No. 4273019, a high-frequency choke coil IL is connectingly provided between the No. 1 pin connection land 110 and a ground electrode 101. Although not shown in the figure, the No. 1 pin is connected directly to the microphone casing.

According the invention described in Japanese Patent Application Publication No. 2007-324804, the first filter circuit 102 for the No. 2 pin on the hot side and the second filter circuit 103 for the No. 3 pin on the cold side, including the printed circuit patterns mounting these filter circuits, are arranged so as to be substantially symmetrical with each other with respect to the middle point line pattern 143, for example, connected to the middle-point tap of the output transformer. Therefore, since the equilibrium of microphone output is maintained up to a high frequency region, even if the microphone is exposed to strong high-frequency electromagnetic waves emitted from a cellular phone or the like, a high-frequency current does not flow in the microphone casing, so that noise can be prevented from being generated by extraneous noise.

Unfortunately, according to invention described in Japanese Patent Application Publication No. 2007-324804, the high-frequency choke coil IL connectingly provided between the No. 1 pin for grounding and the ground electrode 101 is arranged on one side of the filter circuits 102 and 103, for example, so as to be imbalancedly on the first filter circuit 102 side in the example shown in FIG. 7, so that a problem described below is pointed out.

The high-frequency choke coil IL generates a high-frequency magnetic field on account of the feed of high-frequency signals, and is magnetically connected to the inductors (L1 and CL) on the signal side. This magnetic connection (mutual induction) depends on the distance between the parts.

Therefore, high mutual induction is generated between the high-frequency choke coil IL and the inductor close to the high-frequency choke coil IL (for example, the inductor device L1 in the first filter circuit 102), and in contrast, low mutual induction is generated between the high-frequency choke coil IL and the inductor far from the high-frequency choke coil IL (for example, the inductor device L1 in the second filter circuit 103).

For this reason, although the filter circuits 102 and 103 are arranged symmetrically, the symmetry of the high-frequency current collapses, whereby the high-frequency current is allowed to intrude into the microphone casing, so that noise is still generated in some cases.

Accordingly, an object of the present invention is to provide a condenser microphone in which a filter circuit for the No. 2 pin on the hot side and a filter circuit for the No. 3 pin on the cold side are arranged symmetrically on a printed wiring board incorporated in a microphone casing, and a high-frequency choke coil is provided to connect the No. 1 pin for grounding to a ground electrode, wherein a high-frequency magnetic field generated from the high-frequency choke coil is applied evenly to inductors included in the filter circuits.

SUMMARY OF THE INVENTION

To achieve the above object, the present invention provides a condenser microphone including a microphone casing formed of a metallic material; a printed wiring board that has a sound signal output circuit connected to a condenser microphone unit and is housed in the microphone casing; and an output connector which includes a No. 1 pin for grounding, a No. 2 pin on the hot side for signal, and a No. 3 pin on the cold side therefor and is mounted in an end portion of the microphone casing, in which the No. 1 pin is connected directly to the microphone casing and is connected to a ground electrode of the printed wiring board via a high-frequency choke coil; on the printed wiring board, a first filter circuit connected to the No. 2 pin on the hot side and a second filter circuit connected to the No. 3 pin on the cold side, both filter circuits each including capacitor devices and inductor devices, are mounted; and the first filter circuit and the second filter circuit, including printed circuit patterns for mounting these filter circuits, are disposed so as to be substantially symmetrical with each other with respect to an imaginary centerline, wherein the high-frequency choke coil connectingly provided between the No. 1 pin and the ground electrode is provided in the number of two, and these choke coils, together with the first and second filter circuits, are disposed so as to be substantially symmetrical with each other with respect to the imaginary centerline.

According to a preferred mode of the present invention, the imaginary centerline is the centerline of the printed wiring board, which divides the printed wiring board into two parts evenly.

In the case where the sound signal output circuit includes an output transformer, the imaginary centerline is a middle-point line pattern connected to a middle-point tap of the output transformer.

According to the present invention, the high-frequency choke coils connectingly provided between the No. 1 pin for grounding and the ground electrode, together with the first filter circuit connected to the No. 2 pin on the hot side and the second filter circuit connected to the No. 3 pin on the cold side, are disposed so as to be substantially symmetrical with each other with respect to the imaginary centerline. Thereby, high-frequency magnetic fields generated by the high-frequency choke coils are applied evenly to the inductors included in the filter circuits, and mutual induction generated therebetween becomes almost equal.

Therefore, the balance is maintained in terms of high frequency, and a high-frequency current caused by strong extraneous electromagnetic waves emitted from a cellular phone or the like can be inhibited from intruding into the microphone casing with high reliability, so that a condenser microphone having high resistance to noise is provided.

DETAILED DESCRIPTION

Figure 3:
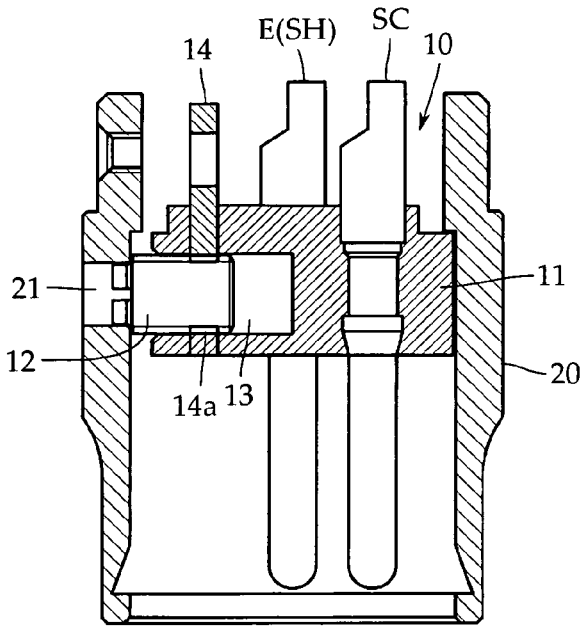
FIG. 3 RELATED ART
FIG. 3 is a sectional view showing a state in which a three-pin type output connector is mounted in a connector housing cylinder.
Figure 4:
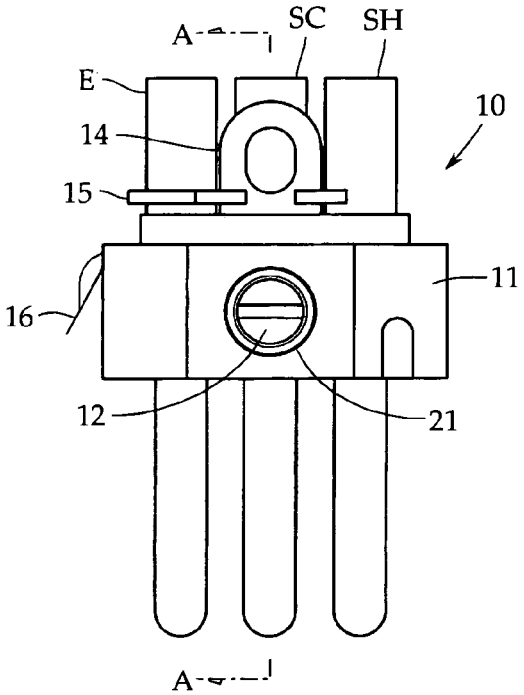
FIG. 4 RELATED ART
FIG. 4 is a front view of the output connector shown in FIG. 3.
Figure 5:
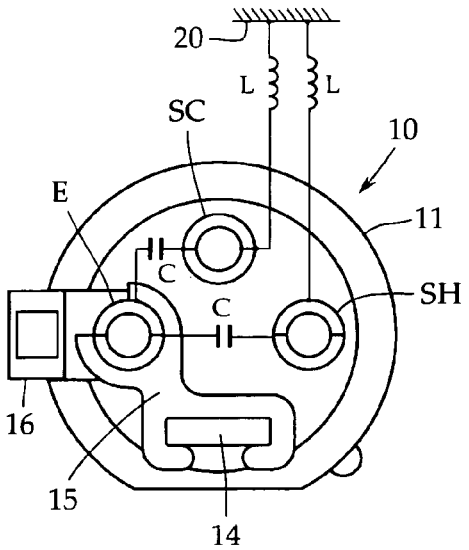
FIG. 5 RELATED ART
FIG. 5 is a plan view of the output connector shown in FIG. 3.
Figure 6:
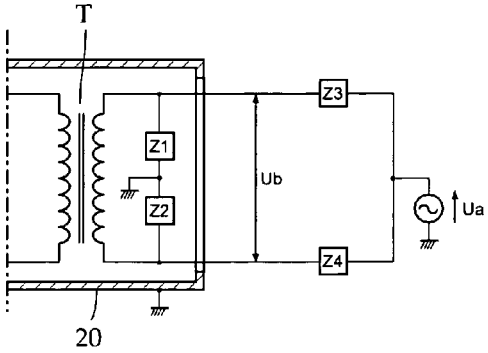
FIG. 6 RELATED ART
FIG. 6 is a schematic view of an output equilibrium circuit of a condenser microphone.
Figure 7:
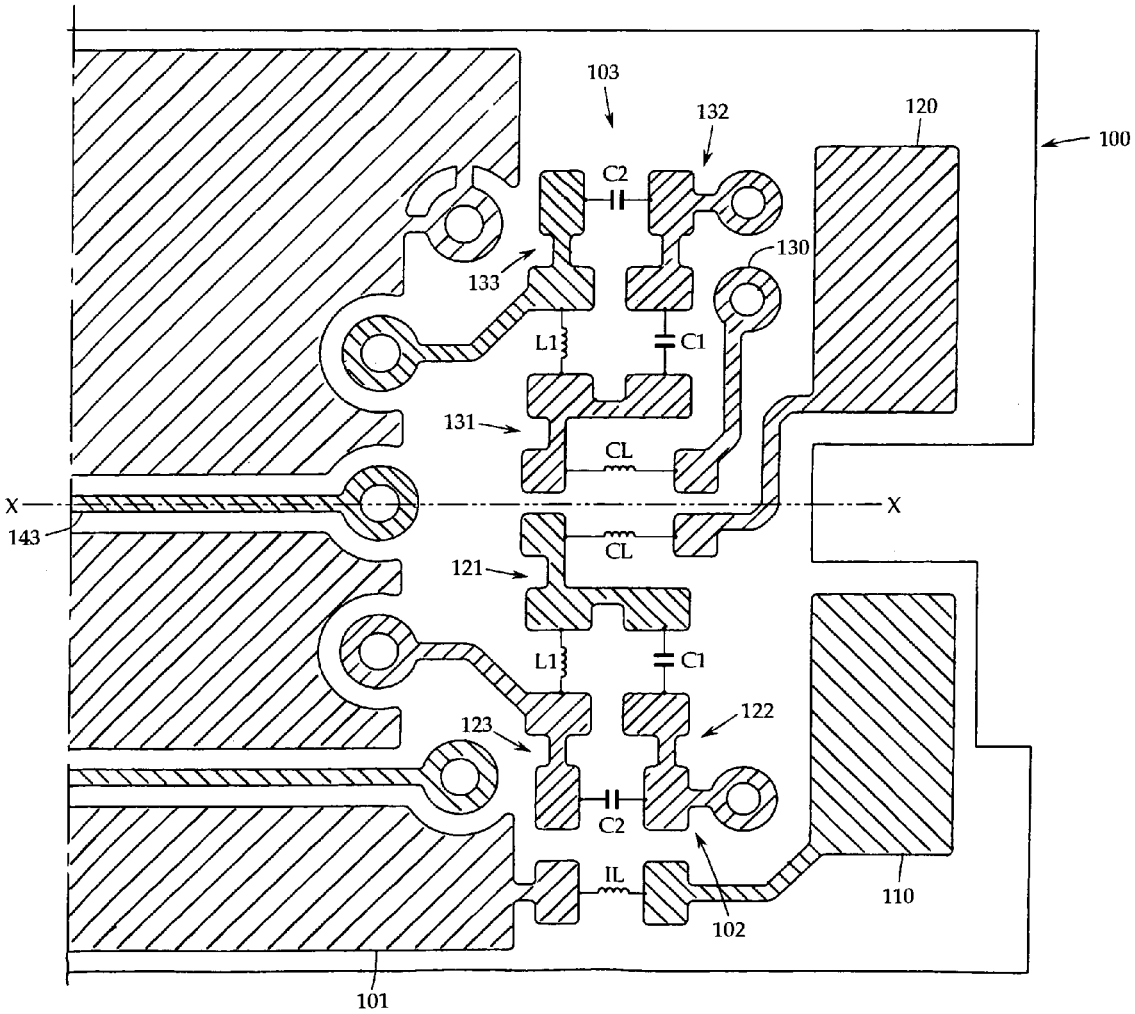
FIG. 7 RELATED ART
FIG. 7 is an enlarged plan view of filter circuits of the invention described in Japanese Patent Application Publication No. 2007-324804.

An embodiment of the present invention will now be described with reference to FIGS. 1 and 2. The present invention is not limited to this embodiment. In the description of this embodiment, since a condenser microphone unit may have a publicly known configuration, the illustration thereof is omitted, and also, as for an output connector, since the before-described three-pin type output connector 10 can be used as it is, refer to FIGS. 3 to 5 as appropriate.

Figure 1:
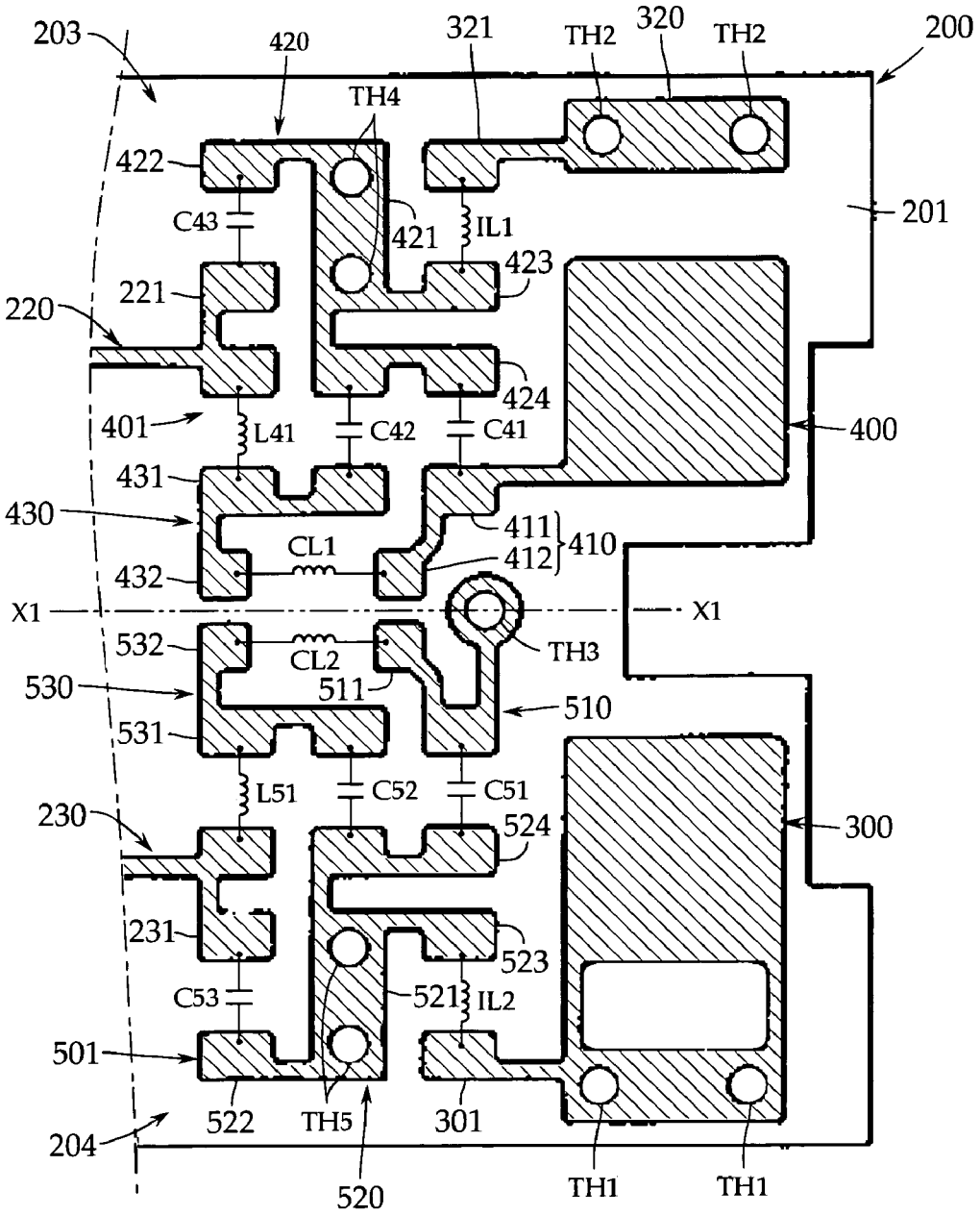
FIG. 1 is a plan view of a filter circuit formed on the top surface side of a printed wiring board that a condenser microphone in accordance with an embodiment of the present invention has.
Figure 2:
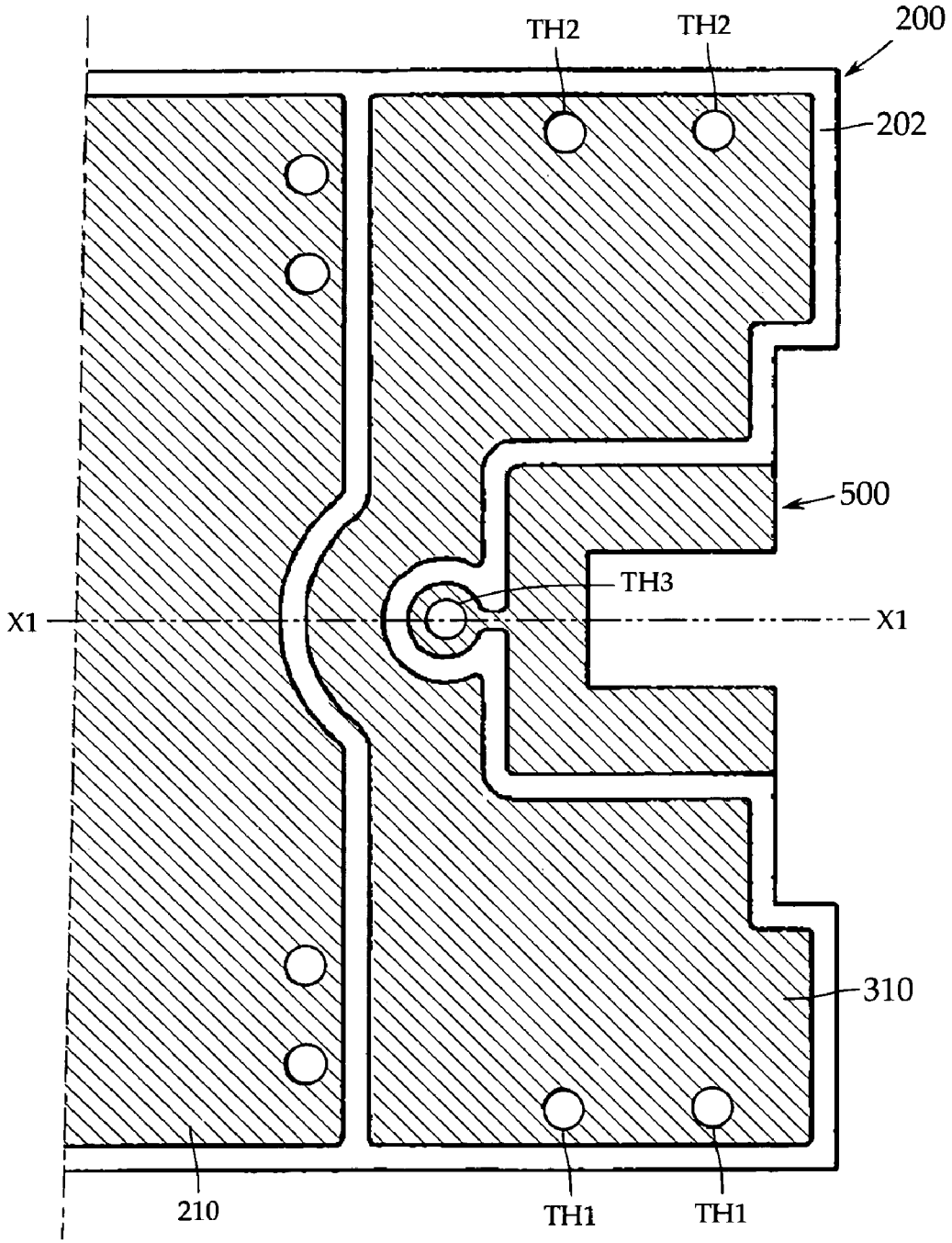
FIG. 2 is a plan view showing the back surface side of the printed wiring board shown in FIG. 1.

FIG. 1 shows the top surface 201 side of a printed wiring board 200 of this embodiment, and FIG. 2 shows the back surface 202 side thereof. The printed wiring board 200 is a wiring board housed in a microphone casing, not shown, formed of a metallic material such as brass having electric conductivity. Although not shown, on the left-hand side in FIG. 1 of the printed wiring board 200, a sound signal output circuit for condenser microphone unit is provided.

In the sound signal output circuit, a PAD circuit, a field effect transistor (FET) serving as an impedance converter, an output transformer, and the like are mounted. Also, on the right-hand side in FIG. 1 of the printed wiring board 200, the output connector 10 is disposed, and pins (No. 1 pin, No. 2 pin, No. 3 pin) are connected to predetermined portions of the printed wiring board 200 directly or via lead wires, not shown.

For the connection with the output connector 10, the printed wiring board 200 includes a No. 1 pin connection land 300 to which the No. 1 pin for grounding is connected, a No. 2 pin connection land 400 to which the No. 2 pin on the hot side is connected, and a No. 3 pin connection land 500 to which the No. 3 pin on the cold side is connected.

In this embodiment, for convenience of lead wiring, wiring board space, and the like, the No. 1 pin connection land 300 and the No. 2 pin connection land 400 are disposed on the top surface 201 side of the printed wiring board 200. In contrast, as shown in FIG. 2, the No. 3 pin connection land 500 is disposed on the back surface 202 side of the printed wiring board 200, and is pulled out to the top surface 201 side via a through hole wiring TH3.

In forming a first filter circuit 401 for the No. 2 pin and a second filter circuit 501 for the No. 3 pin on the top surface 201 side of the printed wiring board 200, the top surface 201 of the printed wiring board 200 is partitioned into a first mount region 203 on the upper side in FIG. 1 and a second mount region 204 on the lower side therein by an imaginary centerline X1-X1.

The centerline X1-X1 may be a wiring board centerline that divides the printed wiring board 200 into two parts evenly. Alternatively, in the case where an output transformer exists in the sound signal output circuit, a middle-point line pattern connected to a middle-point tap of the output transformer may be made the centerline X1-X1. In this embodiment, the centerline X1-X1 is the wiring board centerline.

In this embodiment, the No. 1 pin connection land 300 is disposed on the second mount region 204 side; however, on the first mount region 203 side as well, a No. 1 pin pulling-out electrode 320 electrically connected to the No. 1 pin connection land 300 is provided.

Referring to FIG. 2, on the back surface 202 side of the printed wiring board 200, a connection electrode 310 is formed in an overall pattern shape along the width direction (the up-and-down direction in FIG. 2) of the wiring board, and the No. 1 pin connection land 300 and the No. 1 pin pulling-out electrode 320 are electrically connected to each other via through hole wirings TH1 and TH2 and the connection electrode 310.

Also, as shown in FIG. 2, in the remaining portion (a portion other than the No. 3 pin connection land 500 and the connection electrode 310) of the back surface 202 of the printed wiring board 200, a ground electrode 210 is formed in an overall pattern shape.

Referring to FIG. 1, in the first mount region 203, as a device mounting pattern of the first filter circuit 401 for the No. 2 pin, there are provided a branch electrode 321 connecting with the No. 1 pin pulling-out electrode 320, a branch electrode 410 connecting with the No. 2 pin connection land 400, a first land part 420 and a second land part 430 each formed in an island shape, and an electrode terminal pad 221 formed in an end portion of a signal line 220 leading to one terminal of the sound signal output circuit.

In FIG. 1, taking the lengthwise direction (the right-and-left direction) of the printed wiring board 200 as the transverse direction and the width direction (the up-and-down direction) thereof as the longitudinal direction, the branch electrode 321 is pulled out of the left end of the No. 1 pin pulling-out electrode 320 toward the left direction.

The branch electrode 410 has a first electrode part 411 pulled out of the left end lower side of the No. 2 pin connection land 400 toward the left direction and a second electrode part 412 pulled out of the first electrode part 411 in the left lower slantwise direction toward the centerline X1-X1 side.

The first land part 420 is disposed as a whole in a substantially central portion of the first mount region 203, and has a trunk electrode part 421 formed in the longitudinal direction, a first electrode part 422 pulled out of the upper end of the trunk electrode part 421 toward the left direction, and a second electrode part 423 and a third electrode part 424 pulled out of the lower end side of the trunk electrode part 421 toward the right direction so as to be parallel with each other and in a fork shape.

The trunk electrode part 421 is electrically connected to the ground electrode 210 lying on the back surface 202 of the printed wiring board 200 via through hole wirings TH4.

The first electrode part 422 of the first land part 420 faces the electrode terminal pad 221 of the signal line 220 with a predetermined space provided therebetween, the second electrode part 423 faces the branch electrode 321 with a predetermined space provided therebetween, and a part of the third electrode part 424 faces the first electrode part 411 of the branch electrode 410 with a predetermined space provided therebetween.

The second land part 430 is disposed in the left lower corner of the first mount region 203, and has a first electrode part 431 extending in the transverse direction and a second electrode part 432 extending from the left end of the first electrode part 431 to the lower side in the longitudinal direction.

The first electrode part 431 faces the electrode terminal pad 221 of the signal line 220 and the third electrode part 424 of the first land part 420 with a predetermined space provided therebetween, and the second electrode part 432 faces the second electrode part 412 of the branch electrode 410 with a predetermined space provided therebetween.

In the first mount region 203, there are mounted a harmonic choke coil IL1 constituting the first filter circuit 401 for the No. 2 pin, a common mode choke coil CL1, three capacitor devices C41 to C43, and an inductor device L41. All of these parts are preferably chip parts.

The harmonic choke coil IL1 is connectingly provided between the branch electrode 321 of the No. 1 pin pulling-out electrode 320 and the second electrode part 423 of the first land part 420. The common mode choke coil CL1 is connectingly provided between the second electrode part 412 of the No. 2 pin connection land 400 and the second electrode part 432 of the second land part 430.

The capacitor device C41 is connectingly provided between the third electrode part 424 of the first land part 420 and the first electrode part 411 of the No. 2 pin connection land 400. The capacitor device C42 is connectingly provided between the third electrode part 424 of the first land part 420 and the first electrode part 431 of the second land part 430.

The capacitor device C43 is connectingly provided between the first electrode part 422 of the first land part 420 and the electrode terminal pad 221 of the signal line 220. Also, the inductor device L41 is connectingly provided between the first electrode part 431 of the second land part 430 and the electrode terminal pad 221 of the signal line 220.

In the second mount region 204, as a device mounting pattern of the second filter circuit 501 for the No. 3 pin, there are provided a branch electrode 301 connecting with the No. 1 pin connection land 300, a No. 3 pin pulling-out electrode 510 connecting with the No. 3 pin connection land 500, a first land part 520 and a second land part 530 each formed in an island shape, and an electrode terminal pad 231 formed in an end portion of a signal line 230 leading to the other terminal of the sound signal output circuit.

The branch electrode 301 is pulled out of the left end of the No. 1 pin connection land 300 toward the left direction, and is disposed so as to be symmetrical with the branch electrode 321 with respect to the centerline X1-X1.

The No. 3 pin pulling-out electrode 510 is pulled out of the No. 3 pin connection land 500 on the back surface 202 side to the top surface 201 side via the through hole wiring TH3, and the end portion thereof is provided with a first electrode part 511. The first electrode part 511 is disposed so as to be symmetrical with the second electrode part 412 with respect to the centerline X1-X1.

The first land part 520 is formed as a pattern symmetrical with the first land part 420 with respect to the centerline X1-X1.

That is to say, the first land part 520 has a trunk electrode part 521 formed in the longitudinal direction, a first electrode part 522 pulled out of the lower end of the trunk electrode part 521 toward the left direction, and a second electrode part 523 and a third electrode part 524 pulled out of the upper end side of the trunk electrode part 521 toward the right direction so as to be parallel with each other and in a fork shape.

The first electrode part 522 corresponds to the first electrode part 422 of the first land part 420, and the second electrode part 523 and the third electrode part 524 correspond to the second electrode part 423 and the third electrode part 424, respectively, of the first land part 420.

The trunk electrode part 521 is electrically connected to the ground electrode 210 lying on the back surface 202 side of the printed wiring board 200 via through hole wirings TH5.

The first electrode part 522 of the first land part 520 faces the electrode terminal pad 231 of the signal line 230 with a predetermined space being provided therebetween, the second electrode part 523 faces the branch electrode 301 with a predetermined space being provided therebetween, and a part of the third electrode part 524 faces the No. 3 pin pulling-out electrode 510 with a predetermined space being provided therebetween.

The second land part 530 is formed as a pattern symmetrical with the second land part 430 with respect to the centerline X1-X1. That is, the second land part 530 has a first electrode part 531 extending in the transverse direction and a second electrode part 532 extending from the left end of the first electrode part 531 to the upper side in the longitudinal direction.

The first electrode part 531 faces the electrode terminal pad 231 of the signal line 230 and the third electrode part 524 of the first land part 520 with a predetermined space provided therebetween, and the second electrode part 532 faces the first electrode part 511 of the No. 3 pin pulling-out electrode 510 with a predetermined space provided therebetween.

In the second mount region 204, there are mounted a harmonic choke coil IL2 constituting the second filter circuit 501 for No. 3 pin, a common mode choke coil CL2, three capacitor devices C51 to C53, and an inductor device L51. As all of these parts, parts that are the same as the parts mounted in the first mount region 203 are used.

The harmonic choke coil IL2 is connectingly provided between the branch electrode 301 of the No. 1 pin land 300 and the second electrode part 523 of the first land part 520. The common mode choke coil CL2 is connectingly provided between the first electrode part 511 of the No. 3 pin pulling-out electrode 510 and the second electrode part 532 of the second land part 530.

The capacitor device C51 is connectingly provided between the third electrode part 524 of the first land part 520 and the No. 3 pin pulling-out electrode 510. The capacitor device C52 is connectingly provided between the third electrode part 524 of the first land part 520 and the first electrode part 531 of the second land part 530.

The capacitor device C53 is connectingly provided between the first electrode part 522 of the first land part 520 and the electrode terminal pad 231 of the signal line 230. Also, the inductor device L51 is connectingly provided between the first electrode part 531 of the second land part 530 and the electrode terminal pad 231 of the signal line 230.

Thus, the harmonic choke coils IL1 and IL2, the common mode choke coils CL1 and CL2, the capacitor devices C41 and C51, the capacitor devices C42 and C52, the capacitor devices C43 and C53, and the inductor devices L41 and L51 are disposed so as to be symmetrical with each other, respectively, with respect to the centerline X1-X1.

In particular, since the harmonic choke coils IL1 and IL2 are disposed so as to be symmetrical with each other in the first mount region 203 and the second mount region 204, high-frequency magnetic fields generated by the harmonic choke coils IL1 and IL2 are applied evenly to the inductors (CL1, CL2, L41, L51) included in the filter circuits 401 and 501, and mutual induction generated therebetween becomes almost equal. Therefore, the balance is maintained in terms of high frequency, and a high-frequency current caused by strong extraneous electromagnetic waves emitted from a cellular phone or the like can be inhibited from intruding into the microphone casing with high reliability, so that a condenser microphone having high resistance to noise is provided.

The invention claimed is:

1. A condenser microphone comprising:

a microphone casing formed of a metallic material;

a printed wiring board housed in the microphone casing, and having a sound signal output circuit connected to a condenser microphone unit; and an output connector mounted on the microphone casing, and having a No. 1 pin connected to the microphone casing for grounding, a No. 2 pin on a hot side for signal, and a No. 3 pin on a cold side for signal, wherein the printing wiring board comprises:

a ground electrode, a No. 1 pin connection land connected to the No. 1 pin, a No. 1 pin pulling-out land separated from the No. 1 connection land and electrically connected thereto, a No. 2 pin connection land, said No. 2 pin connection land and No. 1 pin pulling-out land being arranged symmetrically to the No. 1 pin connection land with respect to an imaginary centerline of the printing wiring board, a first land situated adjacent to the No. 1 pin connection land, a second land situated adjacent to the No. 1 pin pulling-out land arranged symmetrically to the first land with respect to the imaginary centerline, and connected to the ground electrode, a first high-frequency choke coil arranged between the No. 1 pin connection-land and the first land, and a second high-frequency choke coil arranged between the No. 1 pin pulling-out land and the second land so that the ground electrode and the No. 1 pin are connected by the first and second high-frequency choke coils.

2. The condenser microphone according to claim 1, wherein the imaginary centerline is a centerline of the printed wiring board, which divides the printed wiring board into two parts evenly.

3. The condenser microphone according to claim 1, wherein the sound signal output circuit includes an output transformer, and the imaginary centerline is a middle-point line pattern connected to a middle-point tap of the output transformer.

4. The condenser microphone according to claim 1, wherein the printed wiring board further comprises a first filter circuit connected to the No. 2 pin, and a second filter circuit connected to the No. 3 pin, each having a printed circuit pattern, a capacitor device and an inductor device, said first and second filter circuits being arranged symmetrically relative to the imaginary centerline.

5. The condenser microphone according to claim 4, wherein the printed wiring board further comprises a connection electrode connecting the No. 1 pin connection land and the No. 1 pin pulling-out land.

6. The condenser microphone according to claim 4, wherein the No. 2 pin connection land is arranged adjacent to the No. 1 pin pulling-out land, and is disposed on one side of the printed wiring board same as that of the No. 1 pin connection land.

7. The condenser microphone according to claim 6, wherein the printed wiring board further comprises a No. 3 pin pulling-out electrode on one side thereof to be arranged symmetrically relative to the imaginary centerline.

* * * * *